United States Patent [19]

Moertel

[11] 4,231,138

[45] Nov. 4, 1980

[54] SLIDE FASTENER

[75] Inventor: George B. Moertel, Conneautville, Pa.

[73] Assignee: Textron, Inc., Providence, R.I.

[21] Appl. No.: 961,449

[22] Filed: Nov. 17, 1978

[51] Int. Cl.[2] ..... A44B 19/02

[52] U.S. Cl. ..... 24/205.16 R

[58] Field of Search ..... 24/205.16 R, 205.16 D, 24/205.13 D, 205.13 R, 205.1 R; 29/410

[56] References Cited

U.S. PATENT DOCUMENTS

| | | | |
|---|---|---|---|
| 1,933,290 | 10/1933 | Winterhalter | 24/205.16 R |
| 2,117,897 | 5/1938 | Marinsky | 24/205.16 R X |
| 2,225,286 | 12/1940 | Poux | 24/205.16 R UX |
| 2,463,840 | 3/1949 | Winterhalter | 24/205.13 R X |
| 2,867,879 | 1/1959 | Urban et al. | 24/205.16 R X |
| 3,072,991 | 1/1963 | Alberts et al. | 24/205.13 D |
| 3,885,273 | 5/1975 | Heimberger | 24/205.13 R X |
| 4,078,278 | 3/1978 | MacFee | 24/205.13 R X |

FOREIGN PATENT DOCUMENTS

| | | | |
|---|---|---|---|
| 446336 | 5/1936 | United Kingdom | 24/205.16 R |
| 1418585 | 12/1975 | United Kingdom | 24/205.16 R |

*Primary Examiner*—Philip C. Kannan

*Attorney, Agent, or Firm*—O'Brien & Marks

[57] ABSTRACT

A slide fastener is disclosed including mounting tapes each having a warpless area or a void area formed in them near their adjacent edges. Coupling elements are secured onto the edges of the mounting tapes and plugs of material interconnecting the legs of each coupling element extend through the void area or warpless area of the mounting tapes. Interconnecting straps are also formed in the warpless areas linking each adjacent pair of the coupling elements.

9 Claims, 11 Drawing Figures

SLIDE FASTENER

BACKGROUND OF THE INVENTION

1. Field of the Invention

The present invention relates to fasteners in general and, in particular, to slide fasteners and the means by which coupling elements of slide fasteners are attached to mounting tapes.

2. Description of the Prior Art

The prior art is generally cognigant of slide fasteners, in which the coupling elements are attached to the mounting tapes by being secured to apertures or cutouts formed in the mounting tapes. Examples of such slide fasteners are shown in U.S. Pat. No. 2,117,897 and No. 3,124,871 and British Pat. No. 446,336. At least two examples are known in the art of slide fasteners utilizing a mesh or wider weave area in the mounting tape for use in coupling element attachment. Examples of such fasteners are shown in U.S. Pat. Nos. 2,225,286 and 4,078,278 and British Pat. No. 1,418,585. No prior art is known which utilizes a warpless area of a woven mounting tape for such attachment.

SUMMARY OF THE INVENTION

The present invention is summarized in that a slide fastener includes a pair of mounting tapes having adjacent side edges, a warpless area formed in each mounting tape proximate the adjacent side edge thereof, a plurality of coupling elements mounted on the adjacent side edges of each of the mounting tapes, and interconnecting straps connecting each of the coupling elements with each of the adjacent coupling elements, the interconnecting straps being formed of the material from which the coupling elements are formed being filled into the warpless areas of the respective mounting tapes.

It is an object of the present invention to construct a slide fastener having thermoplastic coupling elements in which the coupling elements are secured to mounting tapes in a more secure manner than was heretofore possible.

It is another object of the present invention to construct such a slide fastener that is also reinforced so as to resist longitudinal stretching or pulling.

It is yet another object of the present invention to construct such a slide fastener that is more durable and longer-lasting than previously known fasteners.

Other objects, advantages, and features of the present invention will become apparent from the following specification when taken in conjunction with the accompanying drawings.

DESCRIPTION OF THE PREFERRED EMBODIMENT

Figure 1:
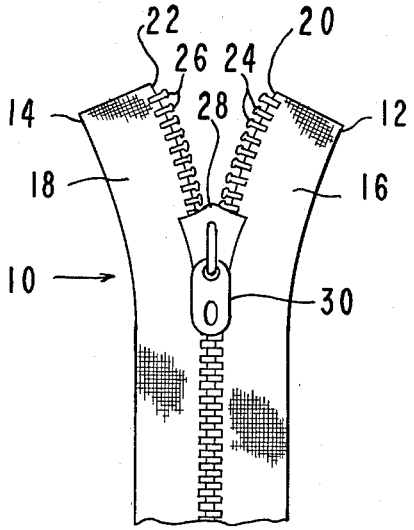
FIG. 1 is a front plan view of a slide fastener constructed in accordance with the present invention.

Shown in FIG. 1 is a slide fastener, generally indicated at 10, constructed in accordance with the present invention. The slide fastener 10 is formed including a pair of slide fastener stringers 12 and 14 which are generally identical in their construction. The stringers 12 and 14 include therein respective mounting tapes 16 and 18 which are positioned so as to have adjacent side edges 20 and 22. A series of thermoplastic slide fastener coupling elements 24 and 26 are mounted on the adjacent side edges 20 and 22 of the mounting tapes 16 and 18 in alternating fashion. A slider 28 is entrained on the coupling elements 24 and 26 so as to be movable there along. A pull tab 30 is attached to the slider 28.

Figure 2:
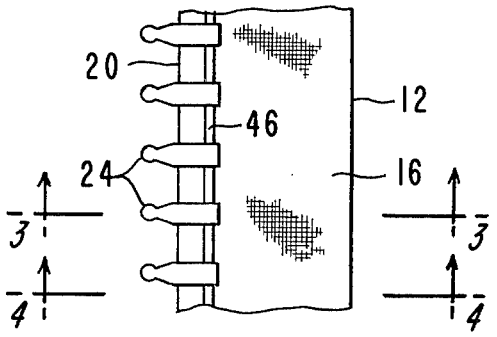
FIG. 2 is an enlarged front plan view of a stringer from the slide fastener of FIG. 1.
Figure 4:
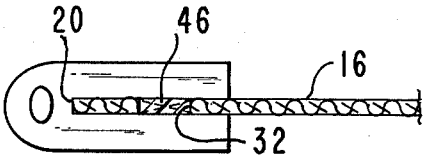
FIG. 4 is a cross-sectional view taken along the line 4—4 in FIG. 2.
Figure 3:
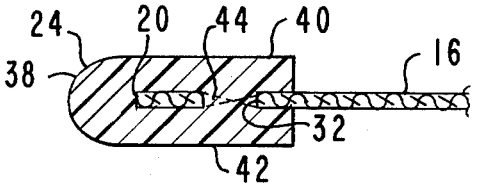
FIG. 3 is a cross-sectional view taken along the line 3—3 in FIG. 2.
Figure 5:
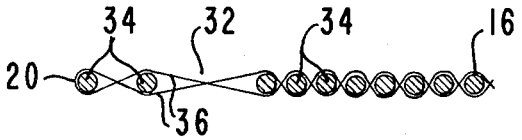
FIG. 5 is a cross-sectional view of a mounting tape from the stringer of FIG. 2.

Shown in FIG. 2 is an enlarged portion of a representative part of the stringer 12. It is to be understood that the stringer 14 is largely identical to the stringer 12 so that only the stringer 12 will be described in detail. As can be seen in the cross sectional views of FIGS. 3 and 4, as well as in FIG. 2, a warpless area 32 is formed in the mounting tape 16 proximate the side edge 20 thereof. The details of construction of the warpless area 26 can be understood best by referring to FIG. 5, which is an enlarged cross-sectional view of a portion of the edge of the mounting tape 16 alone. The mounting tape 16 is a woven fabric composed of warp threads 34 and weft threads 36. In the area of the warpless area 32 a relatively large gap is left between an adjacent pair of the warp threads 34 so that only the weft threads 36 are present therein. To the human eye, the warpless area 32 appears as a windowed, or perforated area of the mounting tape 16. The warpless area 32 is maintained by appropriate sizing agents or other fixing techniques to maintain the spacing between the two closest warp threads 34.

Referring again to FIGS. 2–4, each of the coupling elements 24 includes a head portion 38 and a pair of legs 40 and 42 extending outwardly therefrom in parallel. The coupling elements 24 are positioned so that the side edge 20 of the mounting tape 16 is received up against the underside of the head portion 38 with the legs 40 and 42 being positioned on opposite sides of the mounting tape 16. The legs 40 and 42 extend over and past the warpless area 32 and a plug 44 of thermoplastic material is formed between the legs 40 and 42 filling in a portion of the warpless area 32 and integrally connecting the legs 40 and 42 with each other and with any of the weft threads 36 which extend therethrough. Each adjacent pair of the coupling elements 24 are interconnected by an interconnecting strap 46 of thermoplastic material. The interconnecting straps 46 are formed by thermoplastic material which, during molding of the coupling elements 24, is filled into the area of the warpless area 32. The interconnecting straps 46 are thus formed extending between each adjacent pair of the coupling elements 24 by connecting the plug 44 of material in each of the coupling elements 24 which secures together the legs 40 and 42 thereof with the plug 44 of each of the adjacent coupling elements 24.

In its operation, the slide fastener 10 is operated similarly to conventional slide fasteners. Movement of the slider 28 up and down the slide fastener 10 causes the coupling elements 24 and 26 to be respectfully progressively engaged or progressively disengaged to close and open the slide fastener 10. However, because of its unique structure, the slide fastener 10 has several advantages over previously known fasteners.

In particular, the slide fastener 10 is more durable and stronger than previously known slide fasteners utilizing thermoplastic coupling elements. Through the provision for the warpless areas 32, formed in both the mounting tapes 16 and 18, and the provisions for the plugs 44 and the interconnecting straps 46, the slide fastener coupling elements 24 and 26 are more securely and permanently secured to the mounting tapes 16 and 18 than was heretofore possible. This strong and secure attachment is of great importance to the slide fastener 10 because of the very large lateral tensional forces to which slide fasteners are very often subjected in everyday use. The fact that the legs of the coupling elements 24 and 26 are joined by the plugs 44 of the material through the warpless areas 32 means that the side edges 20 and 22 of the mounting tapes 16 and 18 are completely and tightly encircled by the thermoplastic material. Since the thermoplastic material from which the coupling elements 24 and 26 are composed is normally much more durable, and capable of withstanding much greater force, than textile threads, the connection of the coupling elements 24 and 26 to the mounting tapes 16 and 18 is much more durable and reliable than any sewn attachment.

The provision for the interconnecting straps 46 between the coupling elements not only reinforces the attachment of the coupling elements 24 and 26 to the mounting tapes 16 and 18 but also gives the stringers 12 and 14 more longitudinal strength than was heretofore possible. Since the interconnecting straps 46 are relatively thin, the stringers 12 and 14 are still sufficiently bendable and flexible, but are also more resistant to longitudinal stretching or distortion than was previously possible. Since slide fasteners are often subject to extreme longitudinal pulling forces, such as when the slider temporarily jams, this is also a significant advantage to the slide fastener of the present invention.

It is envisioned that other materials may also be usable for the coupling elements 24 and 26, the plugs 44 and the interconnecting straps 46 of the present invention besides thermoplastic materials. The material chosen, however, must be sufficiently flexible so as not to impede the operation of the slide fastener.

Figure 6:
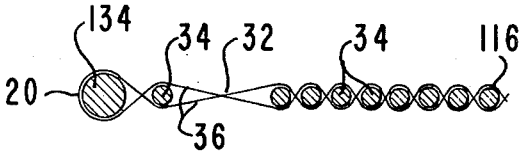
FIG. 6 is a cross-sectional view of an alternative embodiment of the mounting tape of FIG. 5.
Figure 7:
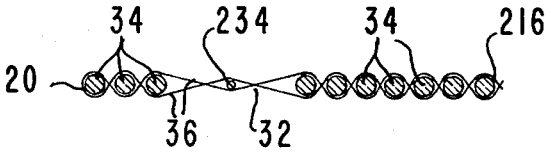
FIG. 7 is a cross-sectional view of another alternative embodiment of the mounting tape of FIG. 5.

It is also envisioned that variations in the design of the mounting tapes 16 and 18 is also possible within the scope of the present invention. Shown in FIGS. 6 and 7 are two alternative embodiments of the mounting tape 16, designated 116 and 216 usable in the present invention. The mounting tape 116 is similar to the mounting tape 16 except that the warp thread 34 on the side edge 20 of the mounting tape 16 has been replaced by a large cord thread 134 which is either a larger diameter filament than the other warp threads 34 or is a bundle of a number of threads similar to the warp threads 34. The mounting tape 216 is similar to the mounting tape 16 except that a spacer monofilament 234 of very small diameter is positioned in the warpless area 32 to provide a filament for the weft threads 36 to loop over in a very wide warpless area 32. Other variations in the mounting tapes are, of course, also possible.

Figure 8:
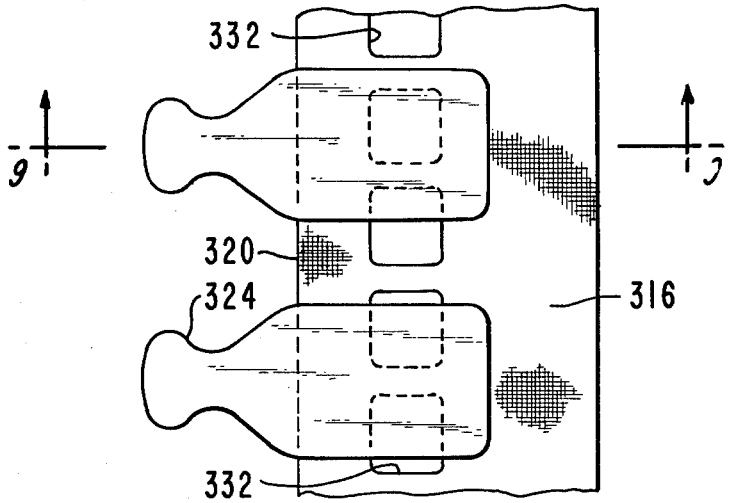
FIG. 8 is an enlarged front plan view similar to FIG. 2 of an alternative embodiment of a stringer according to the present invention.
Figure 9:
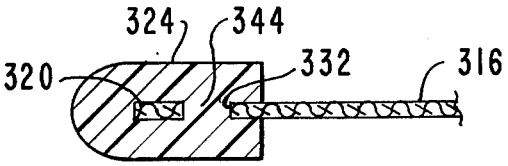
FIG. 9 is a cross-sectional view taken along the line 9—9 in FIG. 8.

Shown in FIGS. 8 and 9 is an alternative method of fastening the thermoplastic coupling elements to a mounting tape. A mounting tape 316 has a plurality of voids 332 formed in it in a longitudinally extending row near the adjacent side edge 320 of the mounting tape 316. The row of voids 332 forms, in effect, a void area proximate the edge 320 of the mounting tape 316. The coupling elements 324 are mounted on the edge 320 of the mounting tape 316 with legs extending on opposite sides of the mounting tape 316. The legs of the coupling element 324 are joined by an interconnecting plug 344 of material which extends through the void 332. As can be seen in FIG. 8, the voids are of such a size and are arranged in such a spacing relative to each other that each of the coupling elements 324 has two of the plugs 344 extending through an adjacent two of the voids 332.

The stringer of FIGS. 8 and 9 also provides a very firm and strong attachment of the coupling element 324 to the mounting tape 316. As can be seen in FIG. 9, the material of the coupling elements 324 completely encircles the portion of the mounting tape 316 adjacent the side edge 320 and thus forms a fastening to the mounting tape 316 that can only be released by tearing the tape itself. This fastening is doubly secure since each of the coupling elements 324 extends through at least two of the voids 332.

Figure 10:
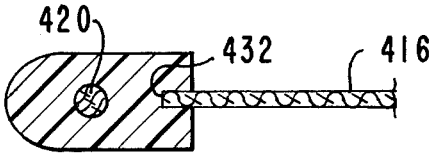
FIG. 10 is a cross-sectional view of an alternative embodiment of the stringer of FIG. 8.
Figure 11:
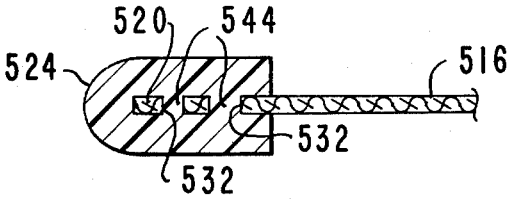
FIG. 11 is a cross-sectional view of another alternative embodiment of the stringer of FIG. 8.

Shown in FIGS. 10 and 11 are alternative embodiments of mounting tapes usable in the stringer of FIG. 8. A mounting tape 416 in FIG. 10 has a thickened cord formed along its side edge 420 and a void 432 formed in the mounting tape 416 extends up to the inward edge of the thickened cord. In FIG. 11 a mounting tape 516 includes a pair of laterally spaced voids 532 each inward of the side edge 520. A coupling element 524 attached to the edge 520 of the mounting tape 516 includes a pair of plugs 544 of material interconnecting the legs of the fastening element 524.

Both of the emobidments of FIGS. 10 and 11 are designed to provide yet additional strength to the attachment of the coupling element to the mounting tape. The embodiment of FIG. 10 provides this additional strength because of the larger diameter of the cord at the edge 420 of the tape. The embodiment of FIG. 11 provides additional strength because the coupling element 524 completely encircles two separate parts of the mounting tape 516, i.e., the edge 520 and the area between the voids 532.

Inasmuch as there are many variations, modifications and changes in detail possible within the present invention, it is intended that all matters contained in the aforegoing description and the accompanying drawings shall be interpreted as illustrative, and not in a limiting sense.

What is claimed is:

1. A slide fastener comprising a pair of mounting tapes having adjacent side edges;

a warpless area formed in each mounting tape proximate the adjacent side edge thereof;

a plurality of coupling elements mounted on the adjacent side edges of each of the mounting tapes; and interconnecting straps connecting each of the coupling elements with each of the adjacent coupling elements, the interconnecting straps being formed of the material from which the coupling elements are formed being filled into the warpless areas of the respective mounting tapes.

2. A slide fastener as claimed in claim 1 wherein each of the coupling elements includes a pair of legs positioned on opposite sides of the respective mounting tape and wherein a plug of material interconnects the legs of each coupling element through the warpless area of the respective mounting tape.

3. A slide fastener as claimed in claim 2 wherein the interconnecting straps connect the plug on each coupling element with the plug in the adjacent coupling element.

4. A slide fastener as claimed in claim 2 wherein the mounting tapes are each formed of warp threads and weft threads and wherein the weft threads extend through the warpless area and are received in the interconnecting straps and the plugs in the coupling elements.

5. A slide fastener stringer comprising a mounting tape with a side edge;

a warpless area formed in the mounting tape proximate the side edge thereof;

a plurality of coupling elements mounted on the side edge of the mounting tape; and interconnecting straps connecting each of the coupling elements with each of the adjacent coupling elements, the interconnecting straps being formed of the material from the coupling elements being filled into the warpless area of the mounting tape.

6. A slide fastener stringer as claimed in claim 5 wherein each of the coupling elements includes a head portion and a pair of legs extending therefrom on opposite sides of the mounting tape, the legs being interconnected by a plug extending through the warpless area.

7. A slide fastener comprising;

a pair of mounting tapes having adjacent side edges;

a series of voids formed in the mounting tapes and arranged in a longitudinally aligned row proximate the side edge of each of the mounting tapes;

a plurality of coupling elements mounted on the adjacent side edges of each of the mounting tapes, each of the coupling elements having a pair of legs extending over opposite sides of the mounting tape; and at least a pair of interconnecting plugs formed in each coupling element extending between the legs of the coupling elements through an adjacent pair of longitudinally aligned voids.

8. A slide fastener as claimed in claim 7 wherein each of the mounting tapes includes a thickened cord located along the side edge thereof.

9. A slide fastener as claimed in claim 7 wherein there are a pair of laterally positioned seeries of voids in each of the mounting tapes and wherein there is an interconnecting plug extending through both of the laterally positioned voids in each of the coupling elements.

* * * * *